US012509190B1

(12) United States Patent
Hu

(10) Patent No.: US 12,509,190 B1
(45) Date of Patent: Dec. 30, 2025

(54) INFLATABLE PADDLE BOARD AND MANUFACTURING METHOD THEREOF

(71) Applicant: Chengji Hu, Qingdao (CN)

(72) Inventor: Chengji Hu, Qingdao (CN)

( * ) Notice: Subject to any disclaimer, the term of this patent is extended or adjusted under 35 U.S.C. 154(b) by 0 days.

(21) Appl. No.: 19/090,326

(22) Filed: Mar. 25, 2025

(30) Foreign Application Priority Data

Feb. 21, 2025 (CN) ..... 202510198886.3

(51) Int. Cl.
*B63B 32/51* (2020.01)
*B63B 32/40* (2020.01)
*B63B 32/57* (2020.01)

(52) U.S. Cl.
CPC ..... *B63B 32/51* (2020.02); *B63B 32/40* (2020.02); *B63B 32/45* (2020.02); *B63B 32/57* (2020.02)

(58) Field of Classification Search
CPC ..... B63B 32/40; B63B 32/51; B63B 32/57; B63B 32/45
See application file for complete search history.

(56) References Cited

U.S. PATENT DOCUMENTS

| | | | | |
|---|---|---|---|---|
| 8,779,025 | B1 * | 7/2014 | Stone | C08L 23/00 523/149 |
| 10,526,047 | B2 * | 1/2020 | Hopkins | B32B 27/283 |
| 11,679,845 | B2 * | 6/2023 | Clark | B63B 32/77 441/66 |
| 2022/0111934 | A1 * | 4/2022 | Zhou | B32B 7/12 |

FOREIGN PATENT DOCUMENTS

| | | | | |
|---|---|---|---|---|
| CN | 203142986 | U * | 8/2013 | |
| CN | 210364286 | U * | 4/2020 | |
| DE | 202021104736 | U1 * | 10/2021 | B63B 32/51 |
| DE | 202020004116 | U1 * | 2/2022 | |
| GB | 2592309 | A * | 8/2021 | B63B 32/40 |

* cited by examiner

*Primary Examiner* — Ajay Vasudeva
(74) *Attorney, Agent, or Firm* — Che-Yang Chen

(57) ABSTRACT

An inflatable paddle board includes an inflatable body, a glue attaching layer, and a padding layer, the glue attaching layer is arranged between a top surface of the inflatable body and the padding layer, so as to reduce the occurrence of bulging and glue peeling, thereby improving the service life of the inflatable paddle board.

12 Claims, 13 Drawing Sheets

INFLATABLE PADDLE BOARD AND MANUFACTURING METHOD THEREOF

CROSS REFERENCE OF RELATED APPLICATION

This application is a non-provisional application that claims priority under 35 U.S.C. § 119 to China application number CN202510198886.3, filing date Feb. 21, 2025, wherein the entire content of which is expressly incorporated herein by reference.

BACKGROUND OF THE PRESENT INVENTION

Field of Invention

The present invention relates to inflatable product, and more particular to an inflatable paddle board and manufacturing method thereof.

Description of Related Arts

Inflatable water sports equipment has gained significant popularity due to its portability, durability, and ease of storage. Designed for activities such as paddle boarding, kayaking, rafting, and recreational floating, these products offer a convenient alternative to traditional rigid equipment while maintaining high performance and safety standards.

As an example, paddle board sports generally encompass a variety of activities that involve using a paddle to propel a board through the water. These sports are enjoyed by people of all ages and skill levels and can be practiced in various water environments, from calm lakes to ocean waves. Inflatable paddle boards have surged in popularity in recent years, thanks to several advantages they offer over traditional hard shell boards. When being deflated, an inflatable paddle board is rolled up into a compact package that easily fits in a backpack, making it ideal for the user who wants to take his or her board on the go. This portability frees the user from needing roof racks to transport the board to the beach or lake.

However, the conventional water sports equipment such as the inflatable paddle board has an disadvantage that an add-on layer, such as an EVA padding layer is glued onto the surface of a board body of the inflatable paddle board to improve its anti-slip performance. However, the bottom of the EVA padding layer is smooth, and there are many drawbacks to directly stick the EVA padding layer to the smooth surface of the board body of the inflatable paddle board through glue. For example, the adhesive structure between the EVA padding layer and the surface of the board body of the inflatable paddle board is easily damaged due to long-term immersion in water and exposure to sunlight, resulting in phenomena such as bulging and glue peeling.

SUMMARY OF THE PRESENT INVENTION

The invention is advantageous in that it provides an inflatable paddle board and manufacturing method thereof, wherein a padding layer is firmly attached to an inflatable body of the inflatable paddle board via a glue attaching layer to reduce the occurrence of bulging and glue peeling, thereby improving the service life of the inflatable paddle board.

Another advantage of the present invention is to provide an inflatable paddle board and manufacturing method thereof, wherein the inclusion of the glue attaching layer between the padding layer and the inflatable body serves to increase the adhesive grasp. By providing a more stable surface for the adhesive to bond with, this layer ensures that the glue is evenly distributed across both the inflatable body and the padding layer. The glue attaching layer acts like a primer, creating a stronger bond between the two surfaces and improving adhesion strength. This results in a more uniform application, ensuring that the padding layer remains firmly attached without weak spots or inconsistencies in the bonding process.

Another advantage of the present invention is to provide an inflatable paddle board and manufacturing method thereof, wherein by adding the glue attaching layer, the risk of detachment is significantly reduced, particularly along the edges. This innovation strengthens the integrity of the bond and prevents premature peeling, ensuring that the padding layer stays securely in place throughout its lifespan.

Another advantage of the present invention is to provide an inflatable paddle board and manufacturing method thereof, wherein by creating a stronger bond and ensuring a more even application of adhesive, the glue attaching layer contributes to the overall durability of the inflatable paddle board. The padding layer will not only remain securely attached, but the inflatable paddle board will be better equipped to handle the wear and tear of regular use, including contact with water, UV rays, abrasions from dragging, and exposure to varying temperatures. The result is a product that can withstand prolonged use, reducing the need for repairs or replacements due to adhesion failure.

Another advantage of the present invention is to provide an inflatable paddle board and manufacturing method thereof, wherein the improved bonding between the padding layer and the inflatable body enhances the user experience by ensuring a safer and more durable inflatable paddle board. The user is less likely to encounter issues like the padding layer coming loose or causing discomfort due to bumps or uneven surfaces. This contributes to a more comfortable and enjoyable experience for the user, especially in situations where traction and stability are critical.

Additional advantages and features of the invention will become apparent from the description which follows, and may be realized by means of the instrumentalities and combinations particularly pointing out in the appended claims.

According to the present invention, the foregoing and other objects and advantages are attained by an inflatable paddle board, comprising:

- an inflatable body;
- a glue attaching layer; and
- a padding layer, wherein the glue attaching layer is arranged between the inflatable body and the padding layer.

According to an embodiment, wherein the glue attaching layer is adhered between the inflatable body and the padding layer.

According to an embodiment, wherein the glue attaching layer is integrated on the inflatable body and is adhered to the padding layer.

According to an embodiment, wherein the glue attaching layer is integrated on the padding layer and is adhered to the inflatable body.

According to an embodiment, wherein a first adhesive coating layer is used to adhere the padding layer to the glue attaching layer and a second adhesive coating layer is used to adhere the glue attaching layer to a top surface of the inflatable body.

According to an embodiment, wherein the first adhesive coating layer and the second adhesive coating layer are made of same glue material.

According to an embodiment, wherein the first adhesive coating layer and the second adhesive coating layer are made of different glue materials.

According to an embodiment, wherein the first adhesive coating layer is formed by a first glue based on one of polyurethane resin and chloroprene rubber.

According to an embodiment, wherein the second adhesive coating layer is formed by a second glue based on one of polyurethane resin and chloroprene rubber.

According to an embodiment, wherein the first adhesive coating layer is formed by a first glue which is a mixture of acetone, xylene, butanone, methyl acetate, and polyurethane resin, wherein the mass ratios of acetone, xylene, butanone, methyl acetate, and polyurethane resin are as follows: acetone 18%-30%, xylene 20%-25%, butanone 15%-25%, methyl acetate 7%-15%, and polyurethane resin 15%-20%.

According to an embodiment, wherein the second adhesive coating layer is formed by a second glue which is a mixture of acetone, xylene, butanone, methyl acetate, and polyurethane resin, wherein the mass ratios of acetone, xylene, butanone, methyl acetate, and polyurethane resin are as follows: acetone 18%-30%, xylene 20%-25%, butanone 15%-25%, methyl acetate 7%-15%, and polyurethane resin 15%-20%.

According to an embodiment, wherein the glue attaching layer is made of a flexible material.

According to an embodiment, wherein the glue attaching layer is made of mesh fabric.

According to an embodiment, wherein a material of the glue attaching layer is selected from the group consisting of nylon, polyester, polypropylene, polyurethane, polyester and rubber thread, carbon fiber, aramid fiber, PTFE, natural fiber, fiberglass, HDPE, and PEEK.

According to an embodiment, wherein a material of the padding layer is selected from the group consisting of EVA, TPE, rubber, polyurethane, rubberized EVA and neoprene.

According to an embodiment, wherein a material of the padding layer is EVA, wherein the inflatable body is made of drop stitch fabric and a material of a top surface of the inflatable body is PVC or TPU.

According to another aspect of the present invention, a manufacturing method of an inflatable paddle board is provided, wherein the manufacturing method comprises the following steps:

(A) form an inflatable body;
(B) coat a first glue to a bottom surface of a padding layer;
(C) stick a glue attaching layer to the bottom surface of the padding layer coated with the first glue, wherein a first side of the glue attaching layer is stuck to the bottom surface of the padding layer by the first glue;
(D) coat a second glue to a second side of the glue attaching layer;
(E) coat the second glue to a top surface of the inflatable body;
(F) dry the second glue coated to the inflatable body and the glue attaching layer; and
(G) adhere the padding layer stuck with the glue attaching layer to the top surface of the inflatable body in such a manner that the second side of the glue attaching layer being stuck to the top surface of the inflatable body, so as to form a second adhesive coating layer between the glue attaching layer and the top surface of the inflatable body.

According to another aspect of the present invention, a manufacturing method of an inflatable paddle board is provided, wherein the manufacturing method comprises the following steps:

(a) form an inflatable body;
(b) coat a first glue to a first side of a glue attaching layer;
(c) coat a second glue to a second side of the glue attaching layer;
(d) coat the second glue to a top surface of the inflatable body;
(e) dry the second glue coated to the inflatable body, the second glue coated to the glue attaching layer, and the first glue coated to the glue attaching layer; and
(f) adhere the padding layer to the first side of the glue attaching layer via the first glue, so as to form a first adhesive coating layer to the top surface of the inflatable body and adhering the second side of the glue attaching layer to the top surface of the inflatable body, so as to form a second adhesive coating layer between the glue attaching layer and the top surface of the inflatable body.

According to another aspect of the present invention, a manufacturing method of an inflatable paddle board is provided, wherein the manufacturing method comprises the following steps:

(I) Integrate a glue attaching layer on one of an inflatable body and a padding layer; and
(II) Adhere the glue attaching layer between the inflatable body and the padding layer.

According to another aspect of the present invention, a manufacturing method of an inflatable paddle board is provided, wherein the manufacturing method comprises a step of gluing a glue attaching layer between an inflatable body and a padding layer.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
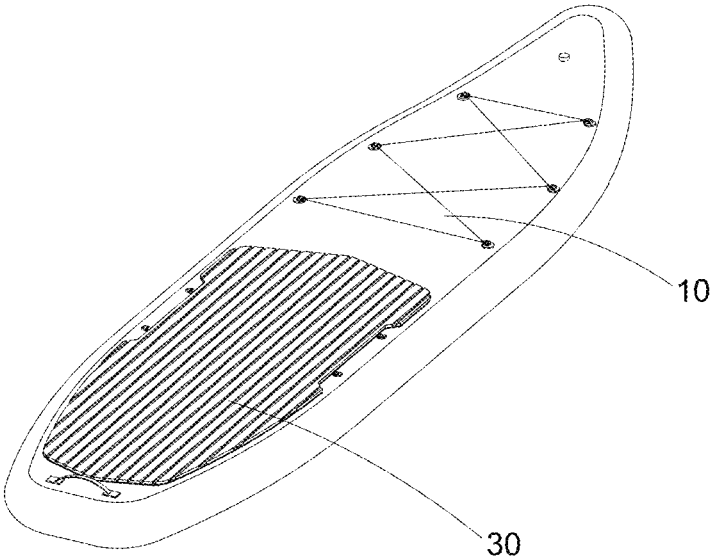
FIG. 1 is a perspective view of an inflatable paddle board according to a first preferred embodiment of the present invention.
Figure 2:
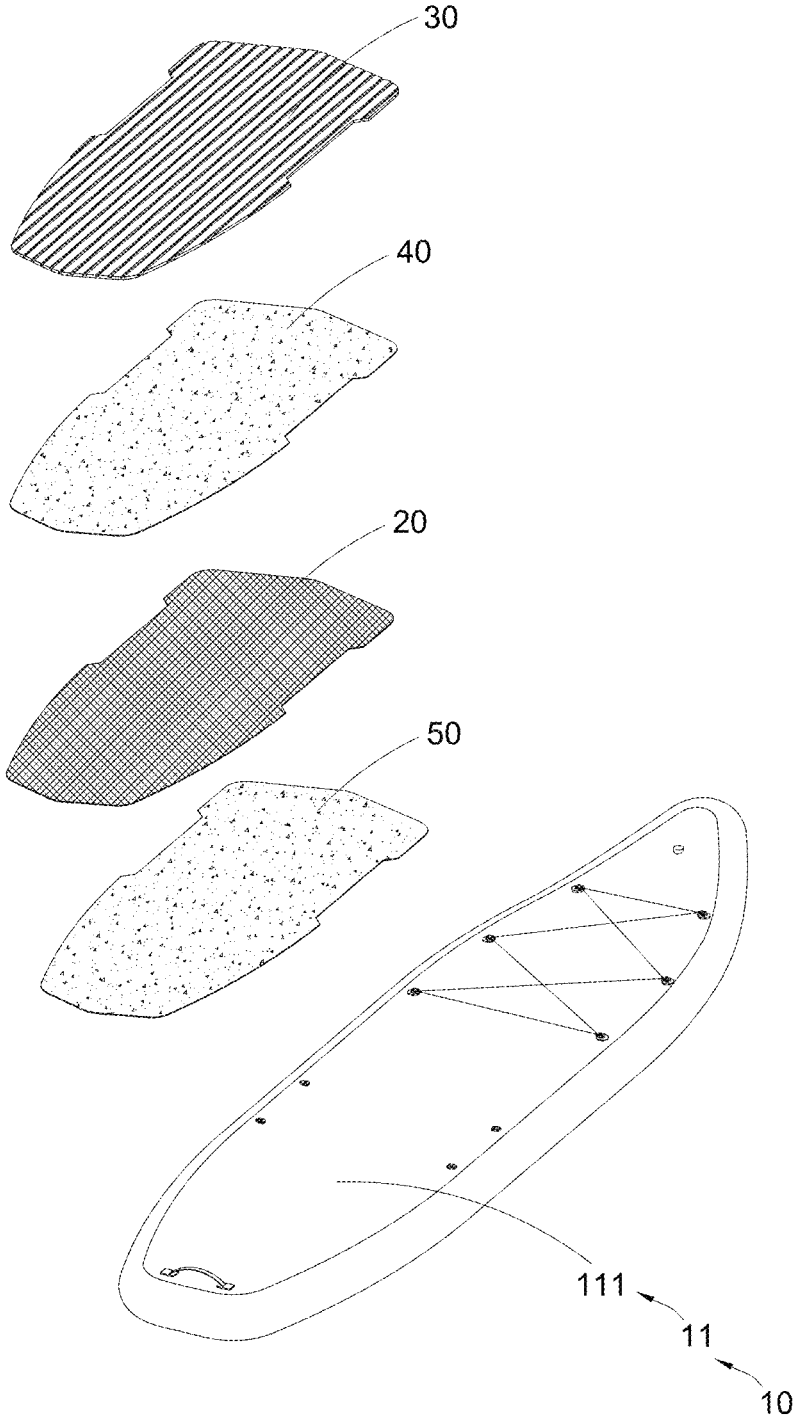
FIG. 2 is an exploded perspective view of the inflatable paddle board according to the above first preferred embodiment of the present invention.
Figure 3:
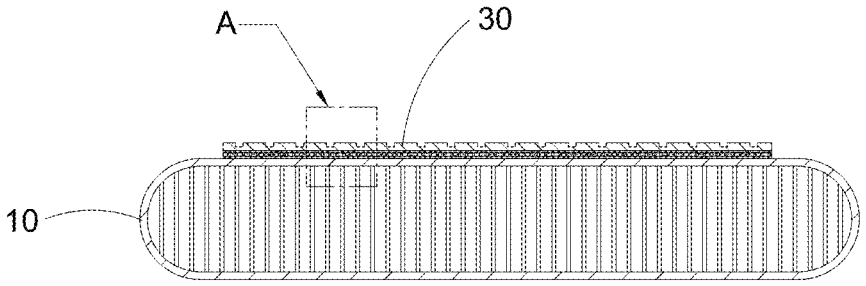
FIG. 3 is a cross sectional view of the inflatable paddle board according to the above first preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

The present invention provides an inflatable paddle board which can be an inflatable paddle board, an inflatable float, an inflatable fishing float or inflatable fishing platform, an inflatable kayak, an inflatable paddle ladder or dog ramp, an inflatable seat, an inflatable sofa, an inflatable gymnastics mat, an inflatable yoga mat, an inflatable tent, or an inflatable bed. In the present invention, a padding layer, such as an anti-slip layer, a seat layer, a standing layer, or an abrasion-resistant pad is firmly attached to an inflatable body of the inflatable paddle board with the aid of a glue attaching layer, so as to increase the adhesive absorption capacity, resulting in stronger adhesion between the materials. The increased friction enhances the bond strength, reducing issues such as edge delamination and blistering, which are common in areas subjected to stress.

Referring to FIGS. 1 to 5C of the drawings, an inflatable paddle board according to a preferred embodiment of the present invention is illustrated, the inflatable paddle board comprises an inflatable body 10, a glue attaching layer 20, and a padding layer 30, wherein the glue attaching layer 20 is arranged between a top surface 11 of the inflatable body 10 and the padding layer 30.

The padding layer 30 in this embodiment, which is an anti-slip layer for a paddler to stand thereon, has an anti-slip top surface 31 and a bottom surface 32, wherein the bottom surface 32 of the padding layer 30 is adhered to the glue attaching layer 20. In detail, the glue attaching layer 20 has a first side 21 and a second side 22, wherein the bottom surface 32 of the padding layer 30 is adhered to the first side 21 of the glue attaching layer 20. The second side 22 of the glue attaching layer 20 is adhered to the top surface 11 of the inflatable body 10.

Compared with the top surface 11 of the inflatable body 10 and the bottom surface 32 of the padding layer 30, the glue attaching layer 20 has better ability to grab glue, so that the glue can be attached to the glue attaching layer 20 more firmly. Due to the glue between the padding layer 30 and the inflatable body 10 is firmly attached to the glue attaching layer 20, the glue between the padding layer 30 and the inflatable body 10 can be coated more evenly and provide better adhesion.

In detail, the glue attaching layer 20 is preferred to be made of a flexible material, more preferred to be made of a mesh fabric which is made from a network of fibers or threads, usually with a woven or knitted structure, wherein the material of the mesh fabric is selected from nylon, polyester, polypropylene, polyurethane, polyester and rubber thread, carbon fiber, aramid fiber, PTFE (Polytetrafluoroethylene), natural fiber, fiberglass, HDPE (High-Density Polyethylene), and PEEK (Polyether Ether Ketone). The glue being coated to the glue attaching layer 20 is partially absorbed into the glue attaching layer 20, so that unnecessary flow of the glue coated to the glue attaching layer 20 can be easily avoided. Under the adsorption effect of the glue attaching layer 20, the glue between the padding layer 30 and the inflatable body 10 can be coated more evenly. On the other hand, the glue attaching layer 20 can hold more glue between the padding layer 30 and the inflatable body 10, so that the padding layer 30 and the inflatable body 10 can be attacked more firmly, so as to reduce the occurrence of bulging, glue cracking.

Figure 4:
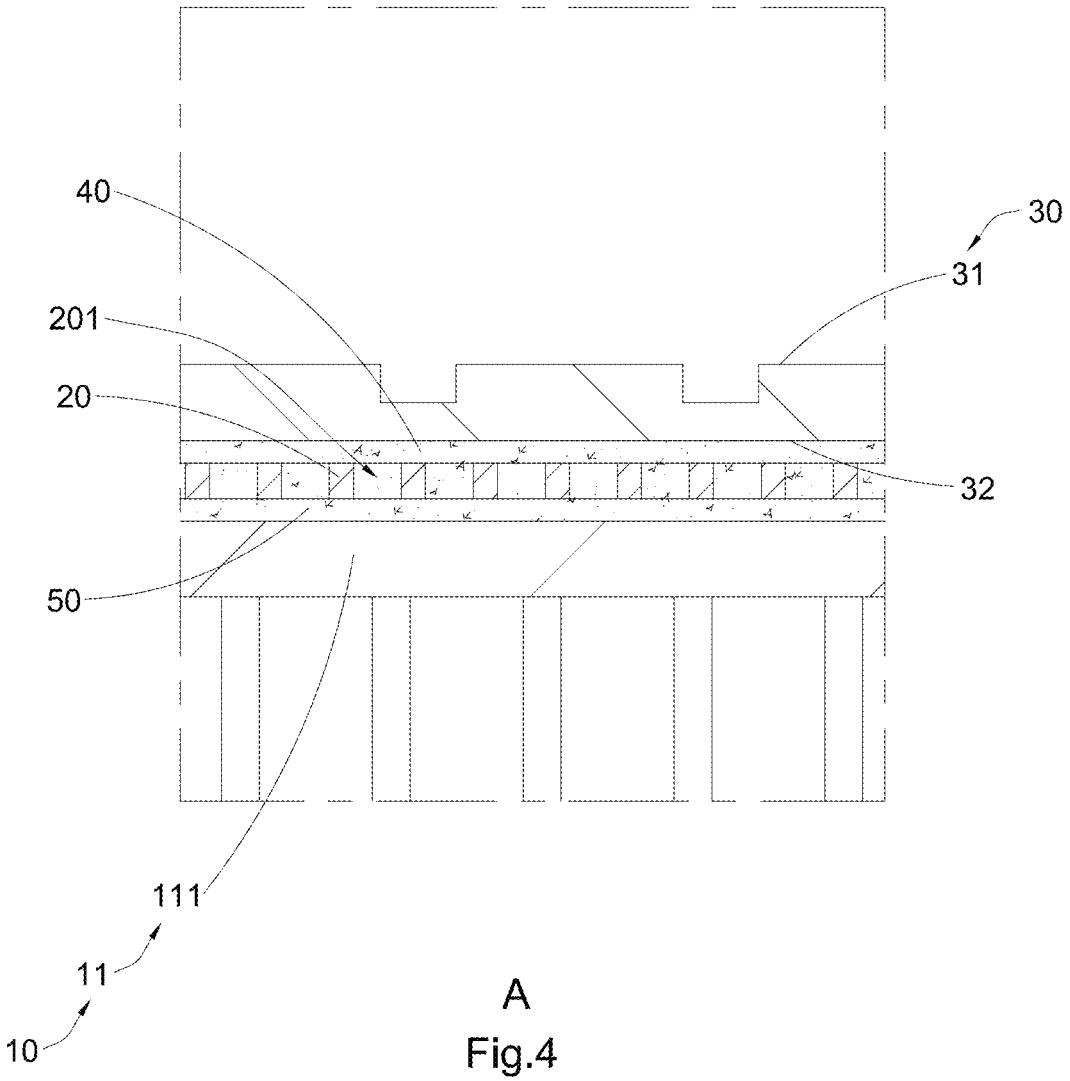
FIG. 4 is a partial enlarged view of an area A of FIG. 3.
Figure 5A:
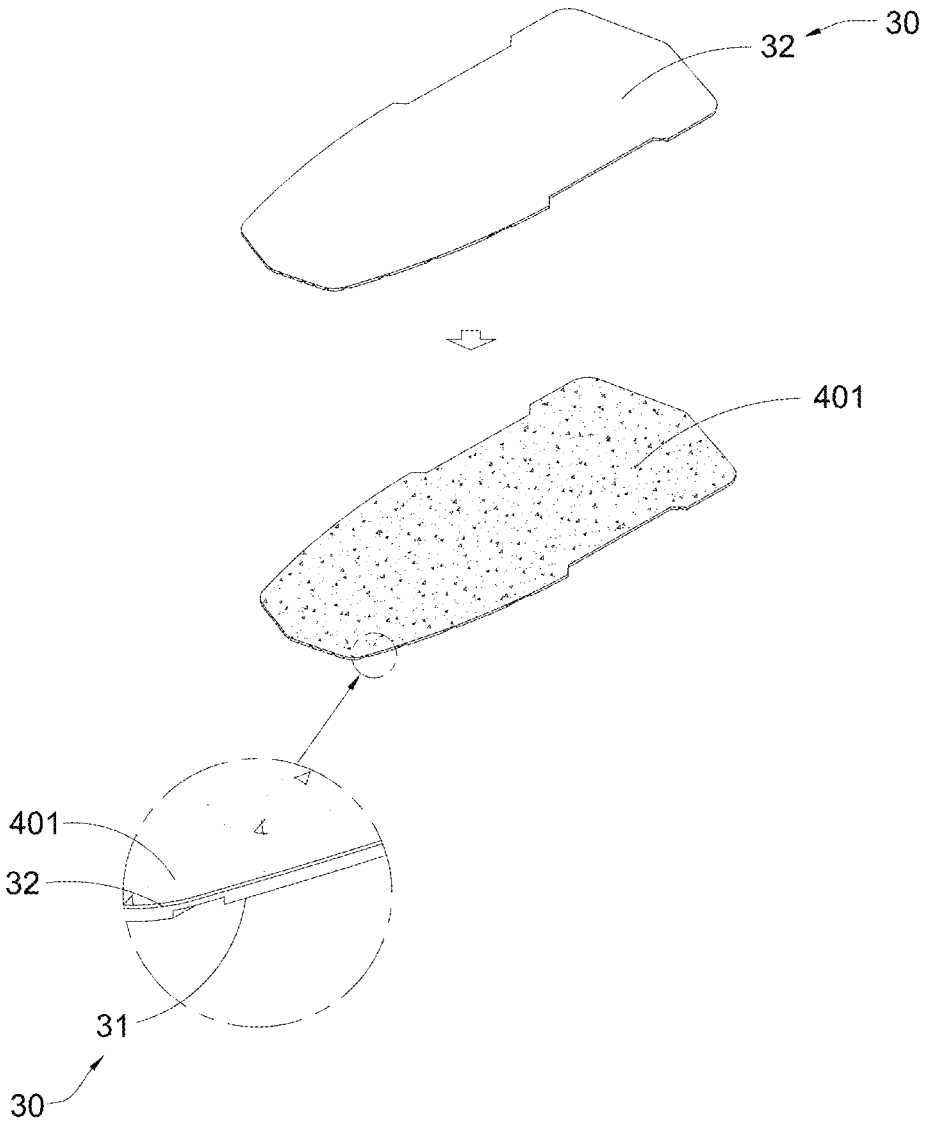
FIGS. 5A to 5C illustrate the process of the first manufacturing method of the inflatable paddle board according to the above first preferred embodiment of the present invention.
Figure 5B:
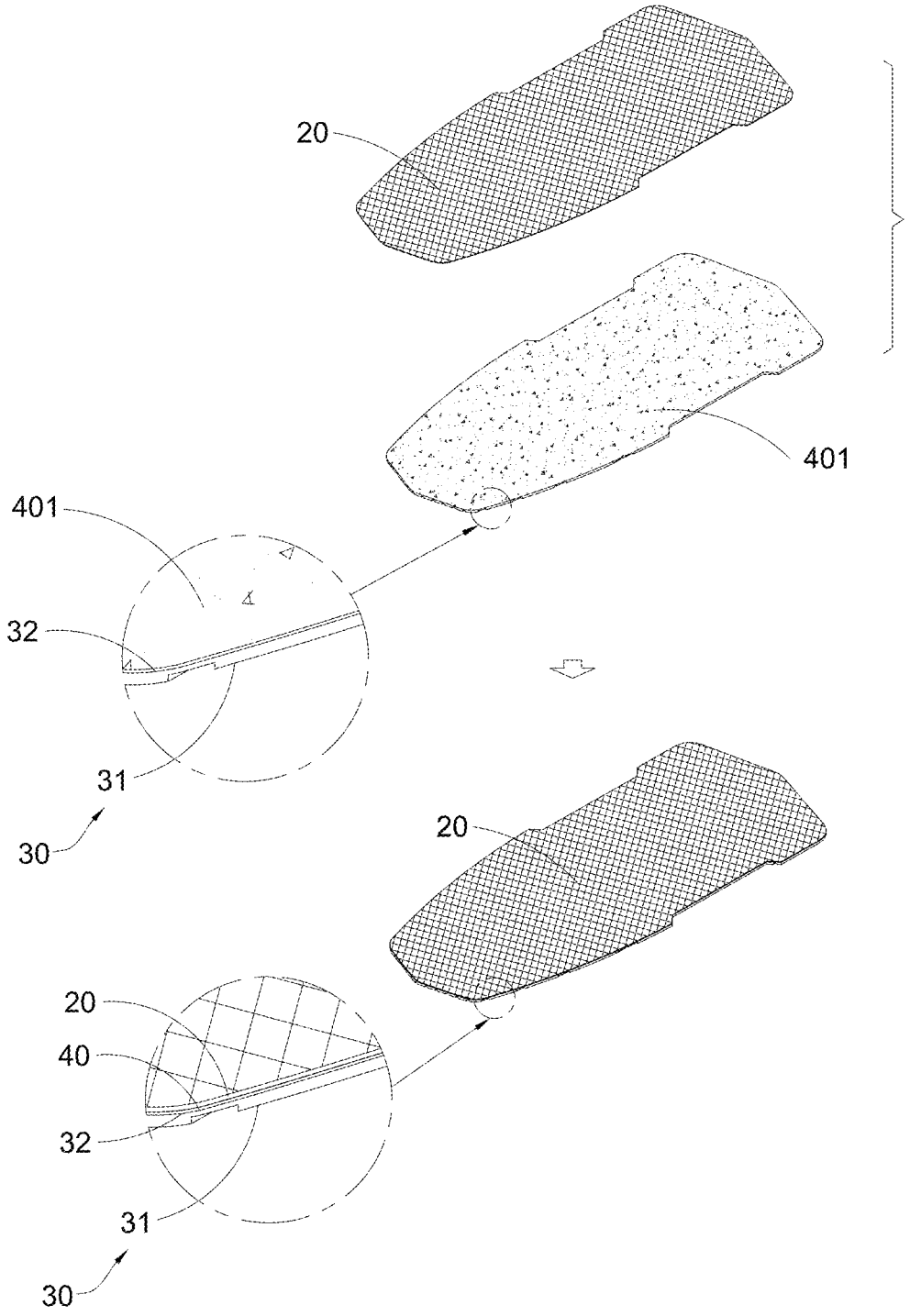
Figure 5C:
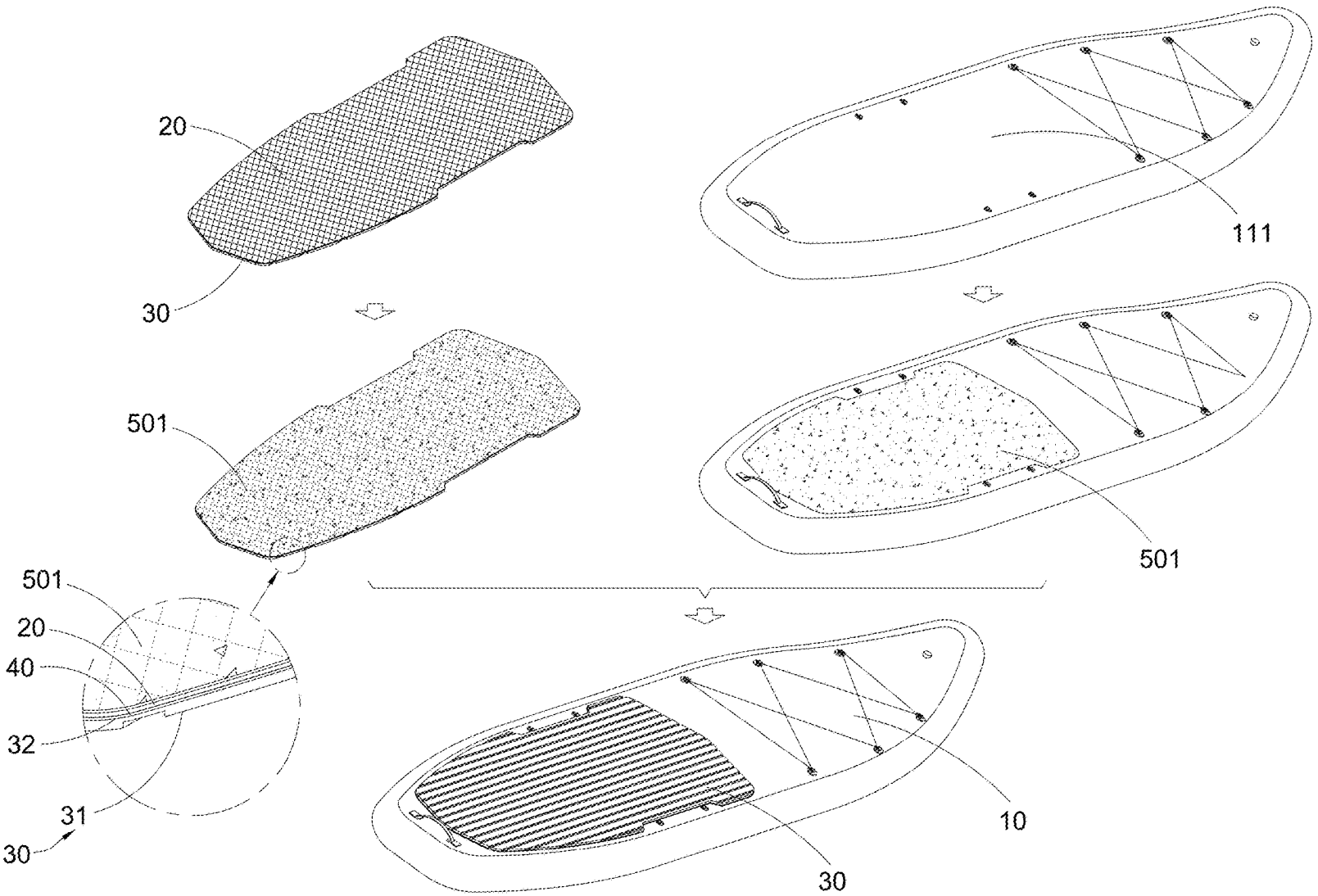

Referring to FIG. 4 to FIG. 5C of the drawings, the inflatable paddle board further comprises a first adhesive coating layer 40 formed by a first glue 401 and a second adhesive coating layer 50 formed by a second glue 501. The first adhesive coating layer 40 is coated on one side of the glue attaching layer 20. The padding layer 30 is covered on the first adhesive coating layer 40, so that the first adhesive coating layer 40 firmly sticks the glue attaching layer 20 and the padding layer 30 together. It is worth to be mentioned that, due to the glue grab ability of the glue attaching layer 20, the first adhesive coating layer 40 is partially implanted into the glue attaching layer 20, so that the first adhesive coating layer 40 is firmly adhered to the glue attaching layer 20 and the first adhesive coating layer 40 is evenly coated on the glue attaching layer 20, so that the first adhesive coating layer 40 sticks the padding layer 30 more firmly, so that the adhering between the padding layer 30 and the glue attaching layer 20 is more firm. In detail, due to the glue grab ability of the glue attaching layer 20, the first adhesive coating layer 40 is partially implanted into the glue attaching layer 20, so that the first adhesive coating layer 40 is firmly adhered to the glue attaching layer 20 and the first adhesive coating layer 40 is evenly coated on the glue attaching layer 20, so that the first adhesive coating layer 40 sticks the padding layer 30 more firmly, so that the adhering between the padding layer 30 and the glue attaching layer 20 is more firmly.

The second adhesive coating layer 50 covers a pad attaching area 111 of the top surface 11 of the inflatable body 10. Also, the second adhesive coating layer 50 is coated on the glue attaching layer 20. In other words, the second adhesive coating layer 50 is extended between the pad attaching area 111 of the top surface 11 of the inflatable body 10 and the glue attaching layer 20, so as to firmly stick the glue attaching layer 20 and the inflatable body 10 together. It is worth to be mentioned that, due to the glue grab ability of the glue attaching layer 20, the second adhesive coating layer 50 is also partially implanted into the glue attaching layer 20, so that the second adhesive coating layer 50 is firmly adhered to the glue attaching layer 20 and the second adhesive coating layer 50 is evenly extended to the glue attaching layer 20, so that the thickness of the second adhesive coating layer 50 can be formed thicker, so that the second adhesive coating layer 50 sticks the padding layer 30 more firmly, so that the adhering between the top surface 11 of the inflatable body 10 and the glue attaching layer 20 is more firmly. In detail, due to the glue grab ability of the glue attaching layer 20, the second adhesive coating layer 50 is partially implanted into the glue attaching layer 20, so that the second adhesive coating layer 50 is firmly adhered to the glue attaching layer 20 and the second adhesive coating layer 50 is evenly coated on the glue attaching layer 20, so that the thickness of the second adhesive coating layer 50 can be formed thicker than directly formed to the bottom surface 32 of the padding layer 30, so that the second adhesive coating layer 50 sticks the padding layer 30 more firmly, so that the adhering between the padding layer 30 and the glue attaching layer 20 is more firmly.

The glue attaching layer 20 is preferred to have a plurality of mesh holes 201 to allow the glue material to enter, so that the first adhesive coating layer 40 and the second adhesive coating layer 50 formed by glue can be implanted into the mesh holes 201 and are evenly formed with the glue attaching layer 20, so that glue material can be coated more evenly.

It is worth to be mentioned that, the first adhesive coating layer 40 may be joined with the second adhesive coating layer 50 in the mesh hole 201, so that the first adhesive coating layer 40 and the second adhesive coating layer 50 collaborate with each other to form a more solid adhesive structure.

By introducing the mesh fabric layer, the improved adhesive bond between the padding layer 30 and the inflatable body 10 becomes more resistant to environmental stresses such as water exposure, UV rays, and temperature changes. This leads to fewer instances of material degradation, extending the lifespan significantly. The user can enjoy a more reliable and long-lasting experience without worrying about the premature wear and tear typical in traditional mats or cushions.

The mesh layer increases the grab of the adhesive, ensuring a more uniform application and bond between the padding layer 30 and the inflatable body 10. This minimizes the risk of detachment, especially at the edges, and significantly reduces the likelihood of blistering or bubbling in high-stress areas. This means the product will maintain its structural integrity under harsh conditions, even with frequent exposure to water or outdoor environments.

With stronger adhesion, the user will notice a smoother, more consistent feel underfoot or during use. The improved non-slip surface provides added safety and stability, which is especially crucial in water sports equipment where balance and traction are essential. Additionally, the overall feel of the product will be more comfortable, contributing to a more enjoyable user experience.

According to this preferred embodiment, the second glue 501 forming the second adhesive coating layer 50 is based on polyurethane resin, such as a mixture of acetone, xylene, butanone, methyl acetate, and polyurethane resin, wherein the mass ratios of acetone, xylene, butanone, methyl acetate, and polyurethane resin are as follows: acetone 18%-30%, xylene 20%-25%, butanone 15%-25%, methyl acetate 7%-15%, and polyurethane resin 15%-20%. The first glue 401 forming the first adhesive coating layer 40 is based on polyurethane resin, such as a mixture of acetone, xylene, butanone, methyl acetate, and polyurethane resin, wherein the mass ratios of acetone, xylene, butanone, methyl acetate, and polyurethane resin are as follows: acetone 18%-30%, xylene 20%-25%, butanone 15%-25%, methyl acetate 7%-15%, and polyurethane resin 15%-20%.

According to an alternative mode of this preferred embodiment, the second glue 501 forming the second adhesive coating layer 50 and the first glue 401 forming the first adhesive coating layer 40 are based on chloroprene rubber, such as a mixture of acetone, butanone, methyl acetate, and chloroprene rubber.

The second glue 501 forming the second adhesive coating layer 50 and the first glue 401 forming the first adhesive coating layer 40 can be same glue material. According to an alternative mode of this preferred embodiment, the second glue 501 forming the second adhesive coating layer 50 and the first glue 401 forming the first adhesive coating layer 40 are different glues, so that the second glue 501 forming the second adhesive coating layer 50 is more suitable to the material of the top surface 11 of the inflatable body 10, and the the first glue 401 forming the first adhesive coating layer 40 is more suitable to the material of the bottom surface 32 of the padding layer 30. As an example, the first glue 401 is based on polyurethane resin while the second glue 501 is based on chloroprene rubber.

According to this preferred embodiment, the material of the padding layer 30 is EVA (Ethylene-Vinyl Acetate). Alternatively, the padding layer 30 can be TPE (Thermoplastic Elastomer), rubber, polyurethane, rubberized EVA or neoprene. The material of the top surface 11 of the inflatable body 10 is PVC (Polyvinyl Chloride) or TPU (Thermoplastic Polyurethanes). Accordingly, the inflatable body 10 is made of drop stitch fabric by interconnecting two layers of fabric with thousands of vertical threads, the top surface 11 is generally PVC.

Referring to FIGS. 5A to 5C, according to a first manufacturing method of the inflatable paddle board according to the above preferred embodiment of the present invention, the manufacturing method comprises the following steps:

(A) forming an inflatable body 10 of the inflatable paddle board;

(B) coating a first glue 401 to a bottom surface 32 of a padding layer 30;

(C) adhering a glue attaching layer 20 to the bottom surface 32 of the padding layer 30 coated with the first glue 401, wherein a first side 21 of the glue attaching layer 20 is stuck to the bottom surface 32 of the padding layer 30 by the first glue 401, wherein the first glue 401 is partial absorbed in to the mesh holes 201 of the mesh fabric of the glue attaching layer 20;

(D) coating a second glue 501 to a second side 22 of the glue attaching layer 20;

(E) coating the second glue 501 to a pad attaching area 111 of a top surface 11 of the inflatable body 10;

(F) drying the second glue 501 coated to the inflatable body 10 and the second glue 501 coated to the glue attaching layer 20;

(G) adhering the padding layer 30 stuck with the glue attaching layer 20 to the top surface 11 of the inflatable body 10 in such a manner that the second side of the glue attaching layer 20 being stuck to the pad attaching area 111 of the top surface 11 of the inflatable body 10, so as to form a second adhesive coating layer 50 between the glue attaching layer 20 and the top surface 11 of the inflatable body 10.

According to this embodiment, the first glue 401 is coated to the bottom surface 32 of the padding layer 30. Via the adhesive effect of the first glue 401, the glue attaching layer 20 and the padding layer 30 are stuck together, so as to form the first adhesive coating layer 40 evenly extending between the glue attaching layer 20 and the padding layer 30. In detail, one side of the first adhesive coating layer 40 is adhered to the bottom surface 32 of the padding layer 30. The other side of the first adhesive coating layer 40 is adhered to the first side 21 of the glue attaching layer 20.

It can be understood that during production, the padding layer 30 can be conveyed to pass through a rotating roller coated with the first glue 401, so that the first adhesive 401 is applied to the bottom surface 32 of the paddling layer 30. Then, the padding layer 30 coated with the first glue 401 is pressed together with the glue attaching layer 20 through the a slot between a pair of pressure rollers, thereby bonding the padding layer 30 and the glue attaching layer 20 with the first glue 401. The pair of pressure rollers can be heated to increase the viscosity of the first glue 401, thereby enhancing the bonding strength between the padding layer 30 and the glue attaching layer 20.

Then, the second side 22 of the glue attaching layer 20 is coated with the second glue 501, and the pad attaching area 111 of the top surface 11 of the inflatable body 10 is also coated with the second glue 501. When the glue attaching layer is a mesh fabric with tiny mesh holes 201, and the second glue 501 is coated to the second side 22 of the glue attaching layer 20, the second glue 501 enters into the mesh holes 201 from the second side 22 of the glue attaching layer 20 and converges with first adhesive coating layer 40 in the mesh holes 201, so as to stick together with the first adhesive coating layer 40.

Before adhering the glue attaching layer 20 to the top surface 11 of the inflatable body 10, the second glue 501 is dried in following drying conditions: drying temperature is 15-30 degrees, drying time is 10-100 minutes.

After the second glue 501 coated to the glue attaching layer 20 and the inflatable body 10 is dried in the above drying conditions, the padding layer 30 stuck with the glue attaching layer 20 is stuck to the top surface 11 of the inflatable body 10 in such a manner that the second side 22 of the glue attaching layer 20 is stuck to the pad attaching area 111 of the top surface 11 of the inflatable body 10, so as to form the second adhesive coating layer 50 between the glue attaching layer 20 and the pad attaching area 111 of the top surface 11 of the inflatable body 10.

Figure 6A:
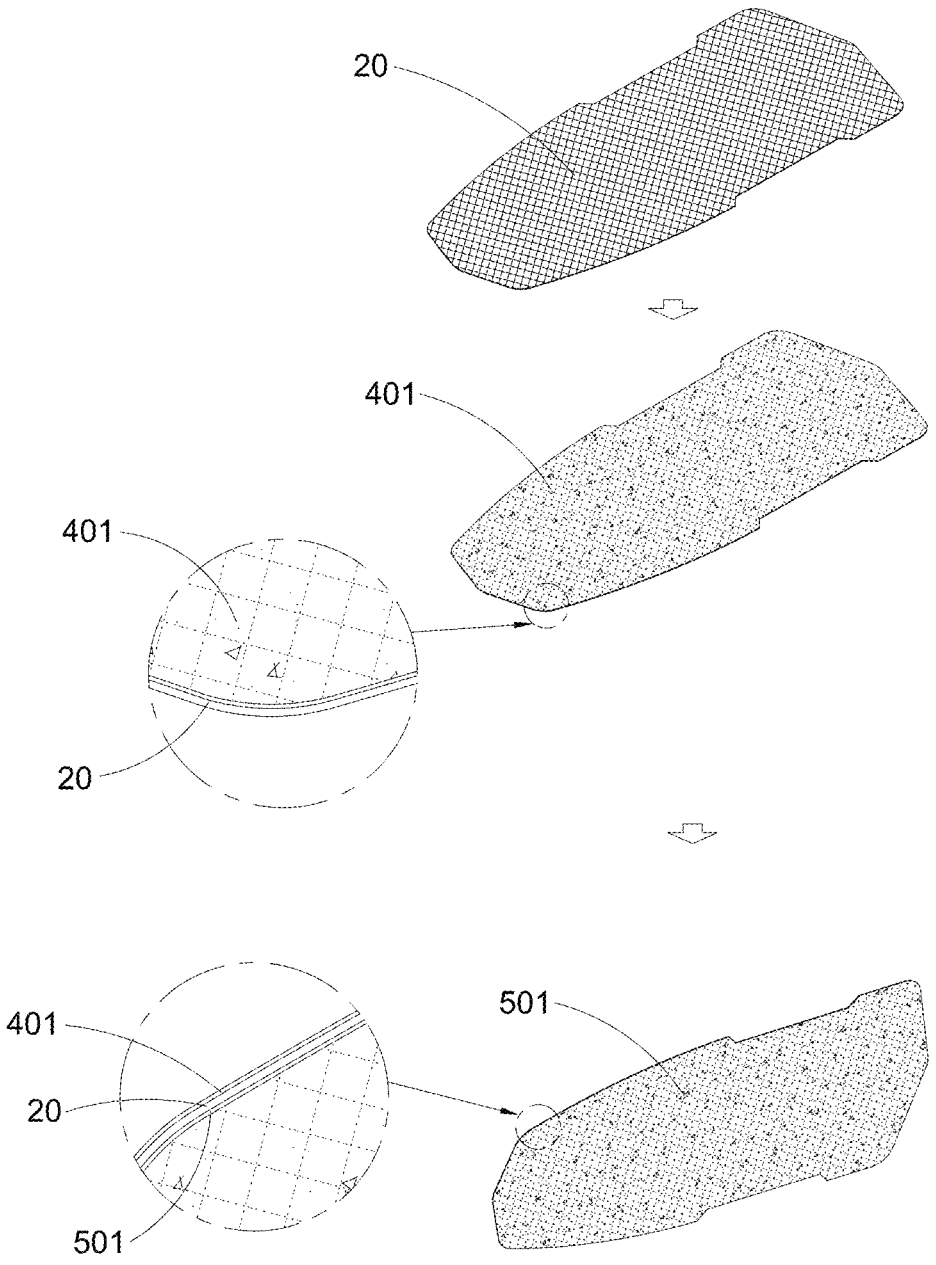
FIGS. 6A to 6B illustrate the process of the second manufacturing method of the inflatable paddle board according to the above first preferred embodiment of the present invention.
Figure 6B:
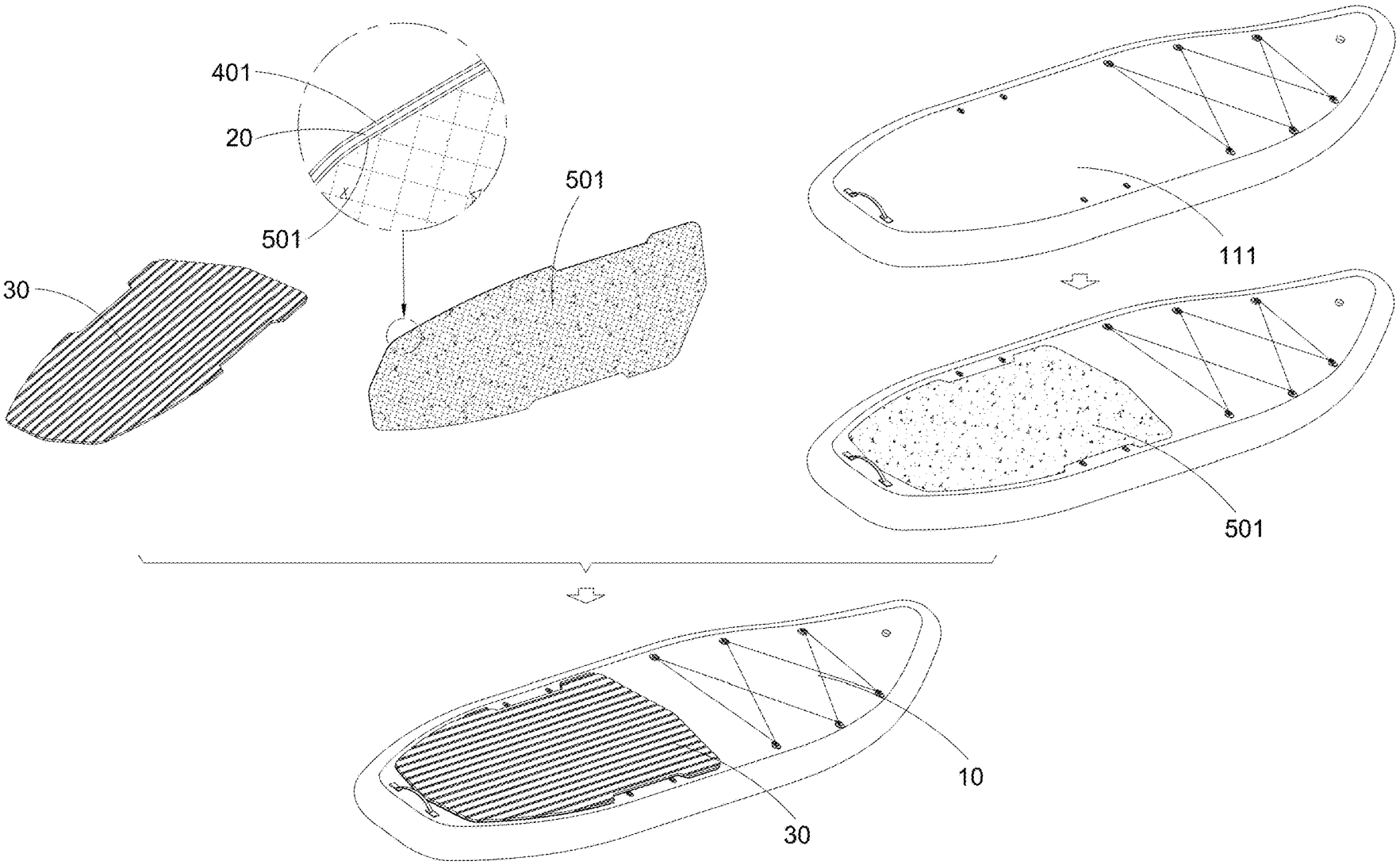

Referring to FIGS. 6A and 6B of the drawings, according to an alternative mode, the manufacturing method of the inflatable paddle board according to the above preferred embodiment of the present invention comprises the following steps:

(a) forming an inflatable body 10 of the inflatable paddle board;

(b) coating a first glue 401 to a first side 21 of a glue attaching layer 20;

(c) coating a second glue 501 to a second side 22 of the glue attaching layer 20;

(d) coating the second glue 501 to a pad attaching area 111 of a top surface 11 of the inflatable body 10;

(e) drying the second glue 501 coated to the inflatable body 10, the second glue 501 coated to the glue attaching layer 20, and the first glue 401 coated to the glue attaching layer 20;

(f) adhering the padding layer 30 to the first side 21 of the glue attaching layer 20 via the first glue 401, so as to form a first adhesive coating layer 40 to the top surface 11 of the inflatable body 10 and adhering the second side 22 of the glue attaching layer 20 to the pad attaching area 111 of the top surface 11 of the inflatable body 10, so as to form a second adhesive coating layer 50 between the glue attaching layer 20 and the top surface 11 of the inflatable body 10.

In this embodiment, the first glue 401 is coated to the first side 21 of the glue attaching layer 20. The second glue 501 is coated to the second side 22 of the glue attaching layer 20. The second glue 501 is coated to the pad attaching area 111 of the top surface 11 of the inflatable body 10.

Before adhering the glue attaching layer 20 to the top surface 11 of the inflatable body 10 and the bottom surface 32 of the padding layer 30, the first glue 401 and the second glue 501 is dried in following drying conditions: drying temperature is 15-30 degrees, drying time is 10-100 minutes.

After the second glue 501 coated to the glue attaching layer 20, the second glue 501 coated to the inflatable body 10, and the first glue 401 coated to the bottom surface 32 of the padding layer 30 are dried in the above drying conditions, the padding layer 30 is stuck to the first side 21 of the glue attaching layer 20 via the first glue 401, so as to form the first adhesive coating layer 40 to the top surface 11 of the inflatable body 10. The second side 22 of the glue attaching layer 20 is stuck to the pad attaching area 111 of the top surface 11 of the inflatable body 10, so as to form the second adhesive coating layer 50 between the glue attaching layer 20 and the top surface 11 of the inflatable body 10.

It is worth mentioning that the glue attaching layer 20 between the inflatable body 10 and the padding layer 30 has glue grab ability, so that the glue between the inflatable body 10 and the padding layer 30 can be extends more evenly and the glue attaching layer 20 helps hold more glue between the inflatable body 10 and the padding layer 30, so that the inflatable body 10 and the padding layer 30 is adhered more firmly, so as to avoid bulging and glue opening.

In other words, the glue attaching layer 20 holds more glue and the glue being held can extends more evenly, so as to form a good adhesive structure of the glue attaching layer 20.

Figure 7:
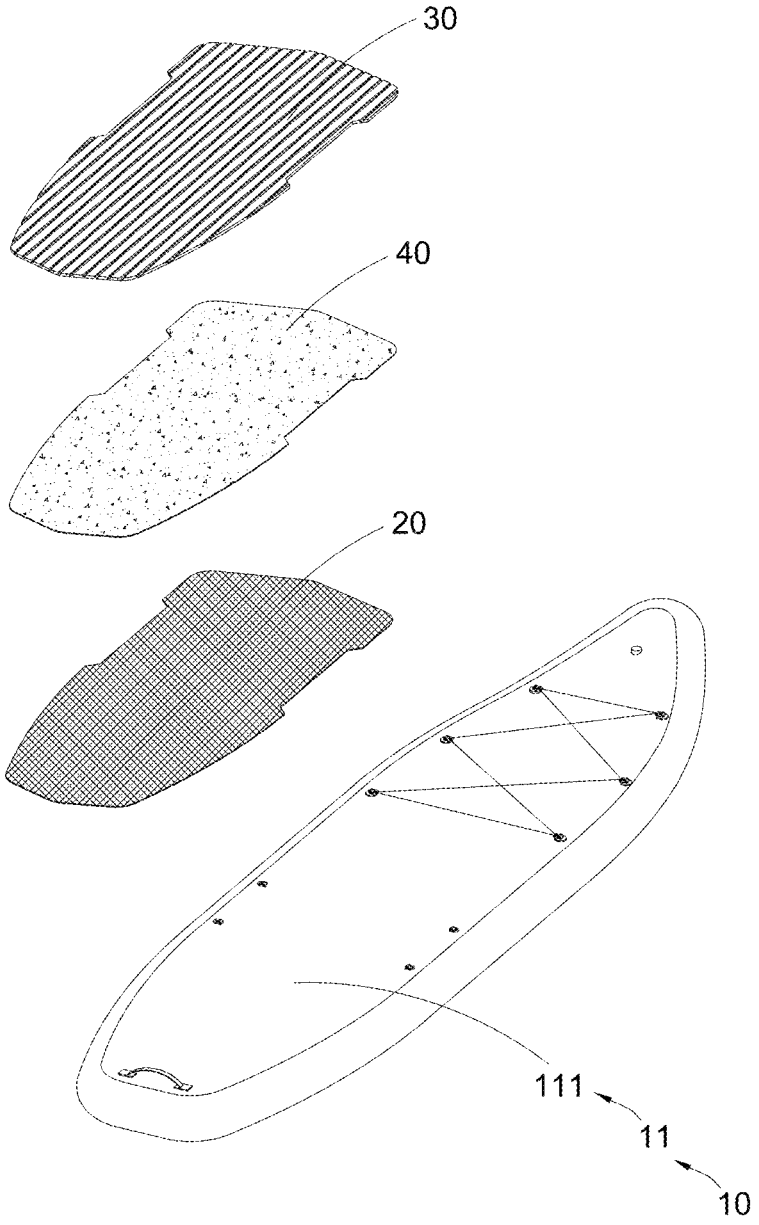
FIG. 7 is an exploded view of an inflatable paddle board according to a second preferred embodiment of the present invention
Figure 8:
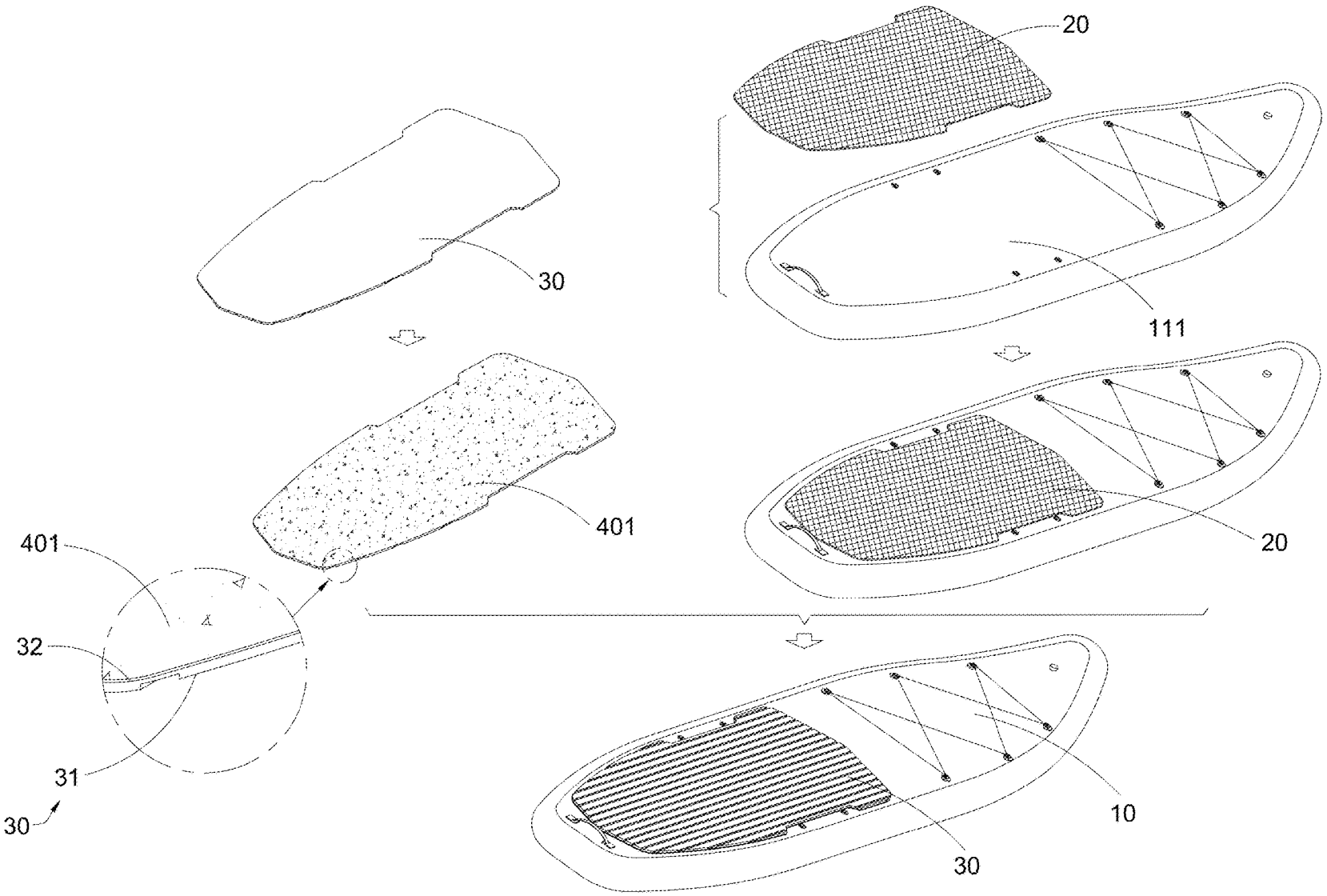
FIG. 8 is a schematic view illustrating the manufacturing process of the inflatable paddle board according to the above second preferred embodiment of the present invention.

Referring to FIG. 7 and FIG. 8 of the drawings, an inflatable paddle board according to a second preferred embodiment of the present invention is illustrated. In this embodiment, the inflatable paddle board comprises an inflatable body 10, a glue attaching layer 20, a padding layer 30, and a first adhesive coating layer 40, wherein the glue attaching layer 20 is arranged between a top surface 11 of the inflatable body 10 and the padding layer 30, the first adhesive coating layer 40 is arranged between the glue attaching layer 20 and the padding layer 30, In this embodiment, the second adhesive coating layer 50 between the glue attaching layer 20 and the inflatable body 10 in the above first preferred embodiment is eliminated, and the glue attaching layer 20 is integrated on the inflatable body 10 by an integration method such as hot lamination and ultrasonic welding.

As an example, the glue attaching layer 20 in this embodiment is integrally formed on the inflatable body 10 by hot lamination. During the heat pressing and melting process, appropriate pressure can be applied to ensure that the materials of the glue attaching layer 20 and the top surface 11 of the inflatable body 10 fully fuse in their molten state. The pressure is typically adjusted based on factors such as material thickness, hardness, and the heat sealing area.

The process typically works well when the glue attaching layer 20 which is made of mesh fabric containing thermoplastic components, such as polyester, nylon, polypropylene, or PU-coated fibers, which can soften and fuse with PVC under heat and pressure.

After the glue attaching layer 20 is integrated on the top surface 11 of the inflatable body 10, a first glue 401 can be applied between the glue attaching layer 20 and the padding layer 30, so as to bind the glue attaching layer 20 with the padding layer 30.

By integrating the glue attaching layer 20 directly onto the top surface 11 of the inflatable body 10 through hot lamination or ultrasonic welding, a much stronger, more durable bond is formed. These methods melt the bonding surfaces, which then cool and solidify to create a fusion between the materials. This eliminates the need for an additional adhesive coating between the inflatable body 10 and the glue attaching layer 20, ensuring a seamless and robust attachment.

The use of hot lamination or ultrasonic welding ensures that the materials are fused at the molecular level, which can greatly improve the overall longevity of the paddle board. The bond between the inflatable body 10 and the glue attaching layer 20 is less likely to degrade over time, which can prevent issues such as delamination or peeling, even after prolonged exposure to water, sunlight, and physical stress.

The enhanced durability and stability of the board lead to a more reliable and safe experience for the user. With the padding layer 30 firmly bonded to the inflatable body 10 via the glue attaching layer 20, users will benefit from a secure grip while paddling, reducing the risk of slipping and improving overall performance.

By applying the first glue 401 between the glue attaching layer 20 and the padding layer 30, manufacturers can tailor the adhesive properties to the specific materials used. This customization allows for more precise control over the bond strength and can help prevent premature wear and tear on the anti-slip surface.

Figure 9:
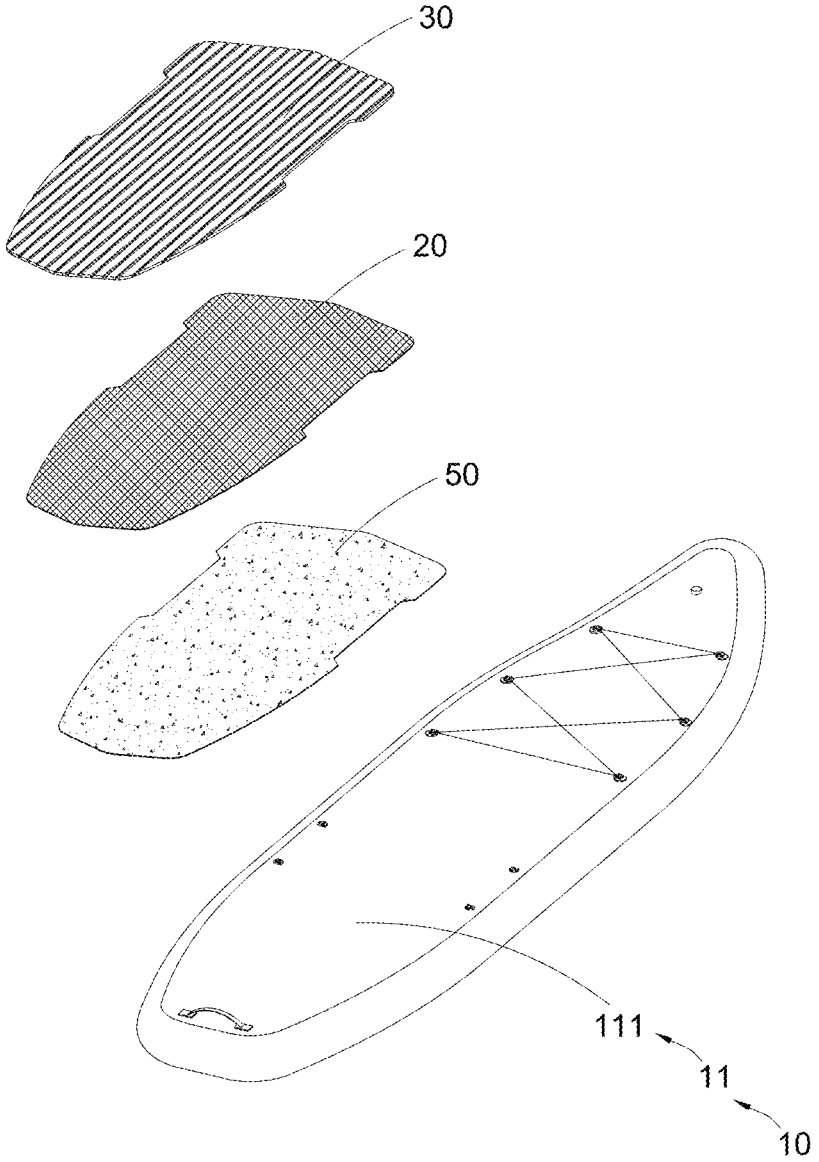
FIG. 9 is an exploded view of an inflatable paddle board according to a third preferred embodiment of the present invention.
Figure 10:
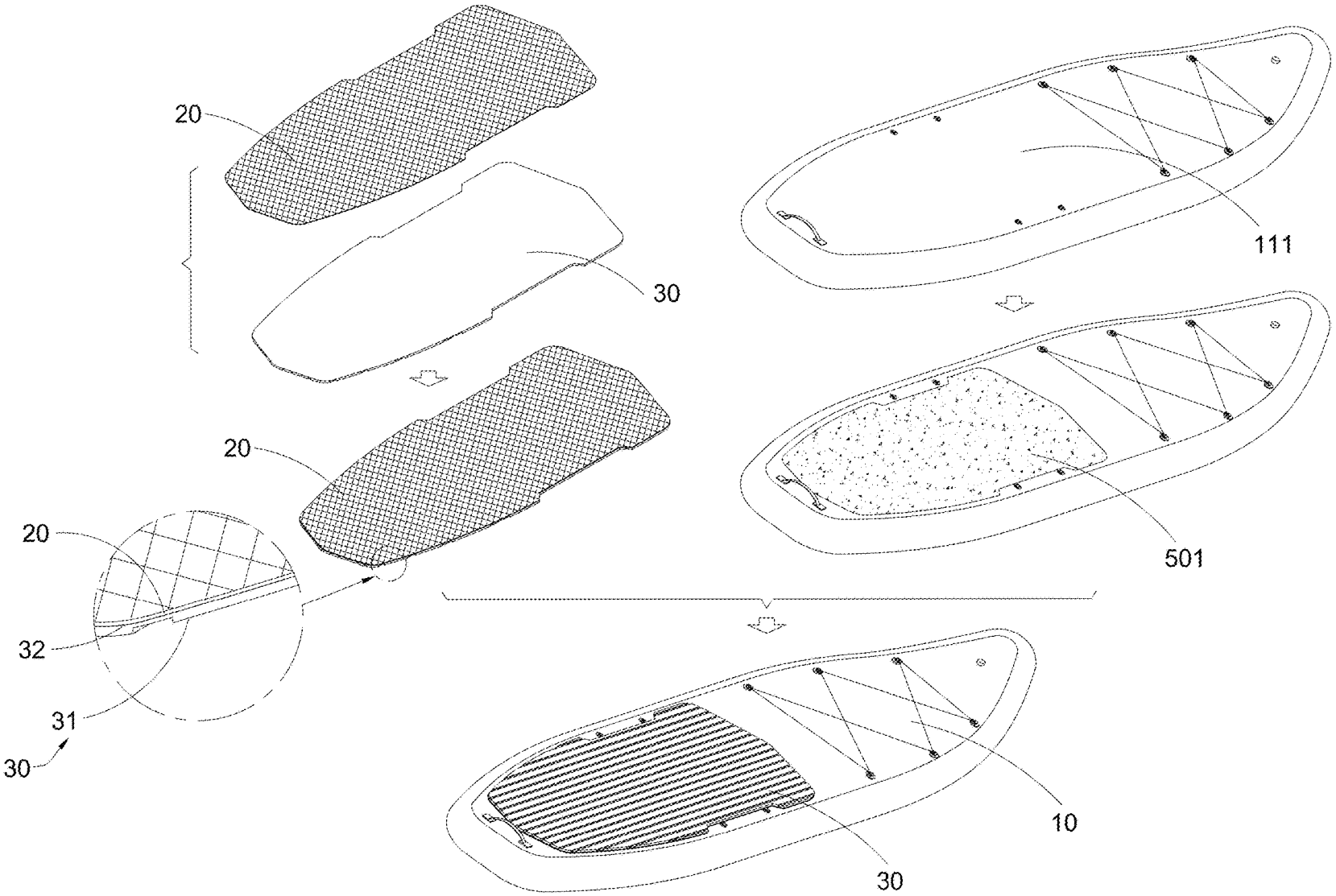
FIG. 10 is a schematic view illustrating the manufacturing process of the inflatable paddle board according to a third preferred embodiment of the present invention.

Referring to FIG. 9 and FIG. 10 of the drawings, an inflatable paddle board according to a third preferred embodiment of the present invention is illustrated. In this embodiment, the inflatable paddle board comprises an inflatable body 10, a glue attaching layer 20, a padding layer 30, and a second adhesive coating layer 50, wherein the glue attaching layer 20 is arranged between a top surface 11 of the inflatable body 10 and the padding layer 30, the second adhesive coating layer 50 is arranged between the glue attaching layer 20 and the inflatable body 10, In this embodiment, the first adhesive coating layer 40 between the glue attaching layer 20 and the padding layer 30 in the above first preferred embodiment is eliminated, and the glue attaching layer 20 is integrated on the padding layer 30 by an integration method such as hot lamination and ultrasonic welding.

After the glue attaching layer 20 is integrated on the padding layer 30, a second glue 501 can be applied between the glue attaching layer 20 and the top surface 11 of the inflatable body 10, so as to bind the glue attaching layer 20 with the top surface 11 of the inflatable body 10.

One skilled in the art will understand that the embodiment of the present invention as shown in the drawings and described above is exemplary only and not intended to be limiting. It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. An inflatable paddle board, comprising:
an inflatable body having a top surface;
a padding layer;
a glue attaching layer arranged between said inflatable body and said padding layer;
a first adhesive coating layer which adheres said padding layer to said glue attaching layer; and
a second adhesive coating layer which adheres said glue attaching layer to said top surface of said inflatable body, wherein a material of said paddling layer is different from a material of said top surface of said inflatable body, and wherein said first adhesive coating layer is formed by a first glue which is a mixture of acetone, xylene, butanone, methyl acetate, and polyurethane resin.

2. The inflatable paddle board, as recited in claim 1, wherein said first adhesive coating layer and said second adhesive coating layer are made of same glue material.

3. The inflatable paddle board, as recited in claim 1, wherein said first adhesive coating layer and said second adhesive coating layer are made of different glue materials.

4. The inflatable paddle board, as recited in claim 1, wherein said second adhesive coating layer is formed by a second glue based on one of polyurethane resin and chloroprene rubber.

5. The inflatable paddle board, as recited in claim 1, wherein said glue attaching layer is made of a flexible material.

6. The inflatable paddle board, as recited in claim 1, wherein said glue attaching layer is made of mesh fabric.

7. The inflatable paddle board, as recited in claim 6, wherein said material of said padding layer is EVA, wherein said inflatable body is made of drop stitch fabric and said material of said top surface of said inflatable body is one of PVC and TPU.

8. The inflatable paddle board, as recited in claim 1, wherein a material of said glue attaching layer is selected from the group consisting of nylon, polyester, polypropylene, polyurethane, polyester and rubber thread, carbon fiber, aramid fiber, PTFE, natural fiber, fiberglass, HDPE, and PEEK.

9. The inflatable paddle board, as recited in claim 8, wherein said material of said padding layer is selected from the group consisting of EVA, TPE, rubber, polyurethane, rubberized EVA and neoprene.

10. The inflatable paddle board, as recited in claim 1, wherein said material of said padding layer is EVA, wherein said inflatable body is made of drop stitch fabric and said material of said top surface of said inflatable body is one of PVC and TPU.

11. An inflatable paddle board, comprising:
an inflatable body having a top surface;
a padding layer;
a glue attaching layer adhered between said inflatable body and said padding layer;
a first adhesive coating layer which adheres said padding layer to said glue attaching layer; and
a second adhesive coating layer which adheres said glue attaching layer to said top surface of said inflatable body;
wherein said first adhesive coating layer is formed by a first glue which is a mixture of acetone, xylene, butanone, methyl acetate, and polyurethane resin, wherein the mass ratios of acetone, xylene, butanone, methyl acetate, and polyurethane resin are as follows: acetone 18%-30%, xylene 20%-25%, butanone 15%-25%, methyl acetate 7%-15%, and polyurethane resin 15%-20%.

12. An inflatable paddle board, comprising:
an inflatable body having a top surface;
a padding layer;
a glue attaching layer adhered between said inflatable body and said padding layer:
a first adhesive coating layer which adheres said padding layer to said glue attaching layer; and
a second adhesive coating layer which adheres said glue attaching layer to said top surface of said inflatable body;

wherein said second adhesive coating layer is formed by a second glue which is a mixture of acetone, xylene, butanone, methyl acetate, and polyurethane resin, wherein the mass ratios of acetone, xylene, butanone, methyl acetate, and polyurethane resin are as follows: acetone 18%-30%, xylene 20%-25%, butanone 15%-25%, methyl acetate 7%-15%, and polyurethane resin 15%-20%.

* * * * *